US005791940A

United States Patent [19]

Chen et al.

[11] Patent Number: 5,791,940

[45] Date of Patent: Aug. 11, 1998

[54] BULB SOCKET AND SOCKET HOLDER ASSEMBLY

[76] Inventors: Chen-Yuan Chen, No. 191, Gi Yang Road; Tsuan Min Wu, No. 54, Lane 122, Section 3, Chung Hwa Rd., both of Hsin Chu City, Taiwan

[21] Appl. No.: 731,795

[22] Filed: Oct. 18, 1996

[51] Int. Cl.[6] ..... H01R 17/00

[52] U.S. Cl. ..... 439/619; 439/699.2

[58] Field of Search ..... 439/611–619, 699.2

[56] References Cited

U.S. PATENT DOCUMENTS

| | | | |
|---|---|---|---|
| 2,511,037 | 3/1950 | Bedoiseau | 439/459 |
| 2,984,813 | 5/1961 | Bossi | 439/619 |
| 3,104,924 | 9/1963 | Capel | 439/619 |
| 3,396,363 | 8/1968 | Suzuki | 439/619 |
| 4,298,923 | 11/1981 | Lin | 439/699.2 |
| 5,620,343 | 4/1997 | Pan | 439/699.2 |

*Primary Examiner*—Hien Vu

*Attorney, Agent, or Firm*—Andrus, Sceales, Starke & Sawall

[57] ABSTRACT

An improved socket and holder assembly is provided which comprises a socket holder having a cylindrical body which defines a socket receiving space therein. The body further includes a conducting plate seat at the inner wall thereof for receiving a conducting plate. The bottom of the body is provided with an opening for inserting a conducting wires. A socket holder has a cylindrical body which defines a bulb receiving space for receiving a bulb therein. The socket body further includes a first extension and a second extension which extend from the bottom of the socket body. The first extension is provided with a pair of passages which are communicated with the bulb receiving space. The second extension is dimensioned such that the bottom of the second extension can be inserted into the bottom opening of the holder.

4 Claims, 2 Drawing Sheets

BULB SOCKET AND SOCKET HOLDER ASSEMBLY

FIELD OF THE INVENTION

The present invention relates to a bulb socket and socket holder assembly, more particularly, to an improved bulb socket and socket holder assembly wherein the rain drop is prevented from permeating into the assembly.

BACKGROUND OF THE INVENTION

The lamps string has been widely used in decorating the Christmas trees, especially in western countries. Nevertheless, more and more eastern people enjoy this global festival. No doubt the pleasant and amiable atmosphere provided by the lamps string is very touching and impressive, especially in the Holy Night. Of course, in some occasion, such as family reunion, the lamps string is indispensable also since it may bring an amiable atmosphere.

As described above, the strings have been widely used indoors and outdoors, nevertheless, problems are raised when the strings are used in outdoors. In winter, snows and rains fall always. As it piles up on the socket and holder assembly, water may leak into the assembly from the bottom of the holder since the electrical conducting wires are passed therethrough. As more and more water drops flow into the assembly, the conducting plates may be rendered short-circuit. The replacement of a burned assembly is very inconvenient since the socket and holder are difficult to separate, especially in such a bad weather condition. On the other hand, it is also difficult to spot out the damaged one.

Since the socket and the holder are engaged with interference fit, accordingly, it is found that the water drop is difficult to permeate into the assembly from the connection between the socket and the holder. Nevertheless, the bottom of the holder has an opening for installing the electric conducting wires. On the other hand, even the opening if disposed with wires, it is not in a sealed and water-tight condition.

In the newly revised UL standards for lamps string, the assembly is required to prevent from the short-circuit when it is used outdoors.

In the U.S. patent application Ser. No. 08/673,182, file on Jul. 3, 1996, by the same applicant of this application, one of the socket and holder is disposed with a drainage slot to discharge the water permeating into the assembly. It is believed that the drainage slot is capable of discharging the water permeated therein and the short-circuit of the lamp can be therefore prevented. But if the water drop is prevent from entering the assembly, it may get of better result in preventing the short-circuit.

SUMMARY OF THE INVENTION

It is the object of this invention to provide an improved socket and holder assembly wherein the bottom of the holder is advantageously clogged and sealed to prevent the permeating water.

It is still the object of this invention to provide an improved assembly wherein the socket and holder can be readily separated to conduct a replacement of a burned out bulb.

In order to achieve the object set forth the improved socket and holder assembly made according to this invention comprises a socket holder having a cylindrical body which defines a socket receiving space therein. The body further includes a conducting plate seat at the inner wall thereof for receiving a conducting plate. The bottom of the body is provided with an opening for inserting a conducting wires. A socket holder has a cylindrical body which defines a bulb receiving space for receiving a bulb therein. The socket body further includes a first extension and a second extension which extend from the bottom of the socket body. The first extension is provided with a pair of passages which are communicated with the bulb receiving space. The second extension is dimensioned such that the bottom of the second extension can be inserted into the bottom opening of the holder.

According to one aspect of this invention the second extension is inserted into the bottom opening of the holder such that the electric conducting wires which pass through the bottom opening of the holder are advantageously sandwiched and sealed between the holder and a second extension of the socket. A water-tight condition is therefore attained at the bottom of the holder and the water is prevented from permeating in.

According to one aspect of the present invention, the second extension is dimensioned such that the bottom of the second extension is projected out of the bottom opening. The socket and the holder can be readily separated when an external force is exerted onto the bottom of the extension.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENTS

Figure 1:
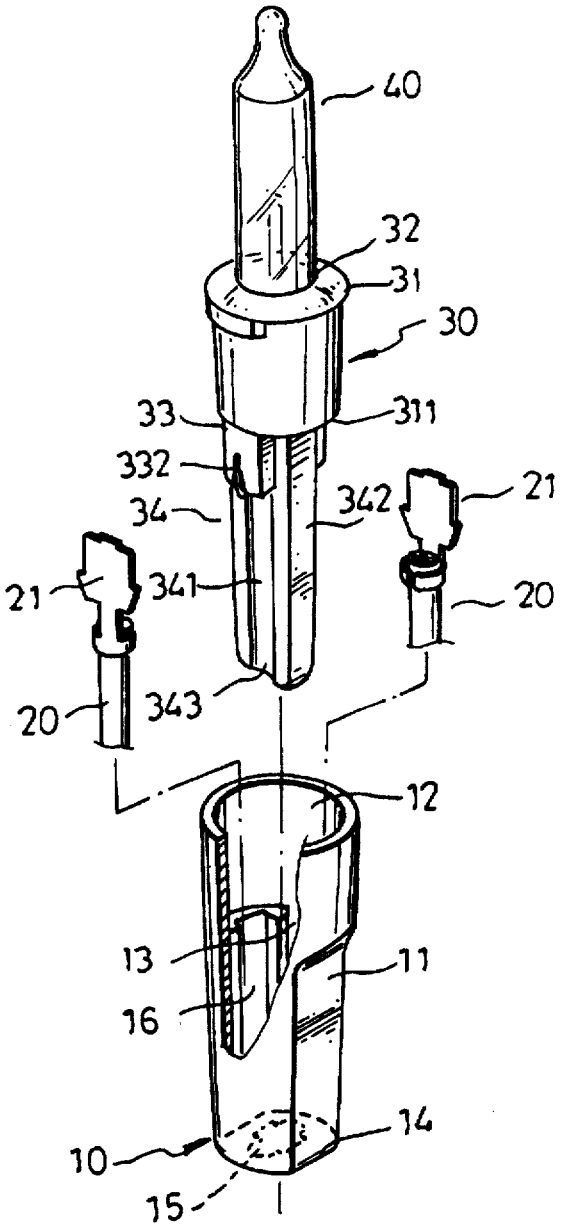
FIG. 1 is a perspective view showing a socket and holder assembly made according to this invention, wherein the holder is partially cutout for ready disclosure.

Referring to FIG. 1, the improved socket and holder assembly made according to this invention comprises a socket holder 10 having a cylindrical body 11 which defines a socket receiving space 12 therein. The body 11 further includes a conducting plate seat 13 at the inner wall thereof for receiving a conducting plate 21 which is attached to one end of an electric conducting wire 20. The bottom 14 of the body 11 is provided with all opening 15 for inserting the conducting wires 20. The inner wall of the body 11 is further disposed with a guiding slot 16.

Figure 2:
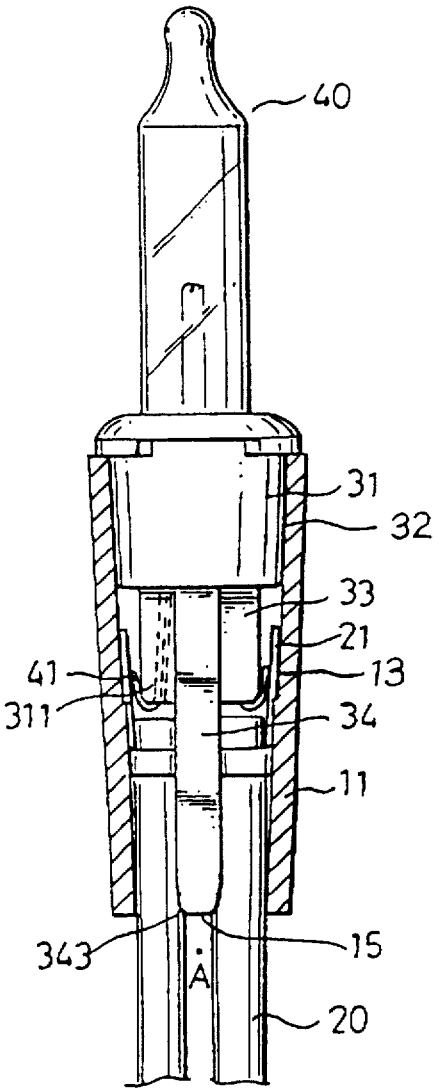
FIG. 2 is a cross sectional view showing all assembled socket and holder assembly.

A bulb socket member 30 is provided which has a cylindrical body 31 which defines a bulb receiving socket 32 for receiving a bulb 40 therein. The socket body 31 further includes a first extension 33 and a second extension 34 which extend from the bottom 311 of the socket body 31. The first extension 33 is provided with a pair of passages 331 (one of which is shown in FIG. 2) which are communicated with the bulb receiving space 32. The first extension 33 is also provided with a cutout 332 adjacent to the outlet of the passage 331 for positioning the legs 41 of the bulb 40, as clearly shown in FIG. 2. The second extension 34 is dimensioned such that the bottom 343 of the second extension 34 can be inserted into the bottom opening 15 of the holder 11. The second extension 34 is also provided with an elongate slot 341. The narrow side 342 of the second extension 34 can be received within the guiding slot 16 of the holder 11 when the socket 30 is assembled to the holder 10.

Referring to FIG. 2, in assembly, the bulb 40 is firstly inserted into the bulb receiving space 32 of the socket body 31 such that the leg 41 of the bulb 40 is passing through the passage 331 and then positioned at the cutout 332 of the first extension 33. On the other hand, the conducting plate 21 is inserted from the bottom opening 15 of the holder body 11 and seats onto the conducting plate seat 13 of the bolder 11 and be snugly retained thereof. Then, the bulb socket 30 is inserted and received into the socket receiving space 12 of the holder 11 such that the narrow side 342 of the second extension 34 is received within the guiding slot 16 and the first extension 33 is seated onto the conducting plate seat 13. Accordingly, an electric contact is established between the conducting plate 21 and the leg 41 of the bulb 40. The bulb 40 is ignited when power is supplied.

Figure 3:
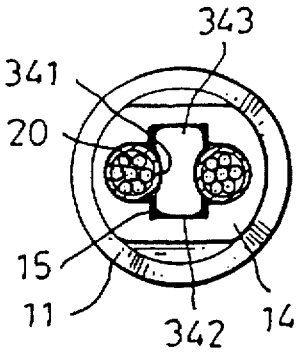
FIG. 3 is an end view of the assembled socket and holder assembly.

Now referring to FIG. 3, the end view of the assembly, as clearly shown in this FIG. 3, the bottom opening 15 is completely filled with a pair of electric wires 20 and the bottom 343 of the second extension 34 such that a water-tight status is established at the bottom opening 15 of the holder 11. By this arrangement, the water drop is prevented from permeating into the assembly.

As shown in FIG. 3, the bottom opening 15 of the holder 11 is specially dimensioned such that it may receive the narrow side 342 of the second extension 34 and the conducting wires 20. When the bottom 343 of the second extension 34 and the conducting wires 20 are well seated, the bottom opening 15 is compactly sealed, as described above.

Besides, in the above described embodiment, the bottom 343 of the second extension 34 may flush to the bottom 14 of the holder 11. Nevertheless, in order to separate the socket 30 and the holder 10 readily, the second extension 34 can be specially dimensioned such that the bottom 343 of the second extension 34 can be extended to the point A, as shown in FIG. 2. By this arrangement, when an external force is applied to the bottom 343 of the second extension 34, the bulb socket 30 can be readily ejected from the holder 10 to perform a replacement of the burned out bulb 40.

While particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

We claim:

1. An improved, weather resistant, bulb socket member and socket holder assembly for a bulb electrically energized by a pair of conducting wires, said assembly comprising:

a socket holder having a top and a bottom, said socket holder having a cylindrical body which defines a receiving space therein for receiving a bulb socket member, the top of said socket holder having an opening through which said bulb socket member may be inserted downwardly into said receiving space, said socket holder further including diametrically opposite conducting plate seats on an inner wall of said socket holder for receiving conducting plates, each of said plates being attached to an end of a conducting wire, the bottom of said socket holder being provided with an opening for inserting the conducting wires into the socket holder, said inner wall of said socket holder being provided with a pair of diametrically opposite guiding slots disposed at locations displaced 90 degrees from said conducting plate seats; and said bulb socket member being formed to pass downwardly through said top opening of said socket holder into said receiving space, said bulb socket member having a cylindrical body which defines a socket for receiving the bulb therein, said bulb socket member body further including an integrally formed first extension and an integrally formed second extension which extend from a bottom of said bulb socket member body, said first extension being provided with a pair of passages which communicate with said bulb receiving socket for containing connecting wires connecting the bulb to said conducting plates when the bulb is received in said socket and said bulb socket member is in said receiving space, said second extension having a rectangular cross section with wide sides and narrow sides, said wide sides being provided with elongated slots, said second extension being dimensioned such that a bottom portion of said extension can be inserted into said bottom opening of said socket holder when said bulb socket member is inserted in said socket holder for sealing, in conjunction with the conducting wires, the opening in the bottom of said socket holder, the narrow sides of said second extension being slidably received in said guiding slots of said socket holder when said bulb socket member is inserted in said socket holder.

2. An improved bulb socket member and socket holder assembly as claimed in claim 1, wherein the bottom portion of said second extension is flush with the bottom of said socket holder.

3. An improved bulb socket member and socket holder assembly as claimed in claim 1, wherein the bottom portion of said second extension projects out of the bottom opening of said socket holder such that when an external force is applied to the bottom portion of said second extension, said bulb socket member can be readily elected from said socket holder.

4. An improved bulb socket member and socket holder assembly as claimed in claim 1, wherein said bottom opening of said socket holder is dimensioned to receive compactly the narrow sides of said second extension and the conducting wires.

* * * * *